United States Patent [19]

Byers et al.

[11] Patent Number: 4,753,922

[45] Date of Patent: Jun. 28, 1988

[54] NEUTRAL-BLACK DYE-DONOR ELEMENT FOR THERMAL DYE TRANSFER

[75] Inventors: Gary W. Byers; Derek D. Chapman; Michael J. McManus, all of Rochester, N.Y.

[73] Assignee: Eastman Kodak Company, Rochester, N.Y.

[21] Appl. No.: 123,441

[22] Filed: Nov. 20, 1987

[51] Int. Cl.[4] ..... B41M 5/035; B41M 5/26

[52] U.S. Cl. ..... 503/227; 8/471; 427/146; 427/256; 428/195; 428/480; 428/913; 428/914

[58] Field of Search ..... 8/471; 427/146, 256; 428/195, 480, 913, 914; 503/227

[56] References Cited

U.S. PATENT DOCUMENTS

| | | | |
|---|---|---|---|
| 4,217,102 | 8/1980 | Stingl | 8/664 |
| 4,412,066 | 10/1983 | Allcock et al. | 528/167 |

FOREIGN PATENT DOCUMENTS

| | | | |
|---|---|---|---|
| 2732356 | 2/1978 | Fed. Rep. of Germany | 8/516 |
| 210769 | 6/1984 | German Democratic Rep. | 430/141 |

*Primary Examiner*—Bruce H. Hess

*Attorney, Agent, or Firm*—Harold E. Cole

[57] ABSTRACT

A neutral-black dye-donor element for thermal dye transfer comprises a support having thereon a dye dispersed in a polymeric binder, the dye comprising a 1-((4-phenylazo)phenylazo)-8-amino-2-naphthol, such as one having the formula:

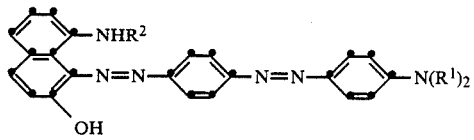

wherein:

each $R^1$ is independently a substituted or unsubstituted alkyl group of from 1 to about 6 carbon atoms, a substituted or unsubstituted aryl group of from about 5 to about 10 carbon atoms, or two $R^1$ groups may be joined together with the N atom to which they are attached to form a 5- or 6-membered heterocyclic ring; and $R^2$ is hydrogen or $R^1$.

20 Claims, No Drawings

NEUTRAL-BLACK DYE-DONOR ELEMENT FOR THERMAL DYE TRANSFER

This invention relates to neutral-black dye-doner elements which have good transfer characteristics and dye light-stability.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-doner element is placed face-to-face with a dye-receiving element. The two are then inserted between a thermal printing head and a platen roller. A line-type thermal printing head is used to apply heat from the back of the dye-doner sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

In certain imaging applications, a neutral-black image is desirable. This can be accomplished by transfer of three individual dyes, cyan, magenta and yellow, but this requires careful balance of the dyes because of different dye extinctions and transfer efficiencies. In addition, this may be costly since three dyes have to be selected, synthesized, and coated. Further, it may be difficult to maintain neutrality due to relative stability changes of each dye during dye-doner keeping and as transferred to the receiver. Thus, there are advantages for having a single neutral-black dye for thermal dye-transfer imaging.

In U.S. Pat. No. 4,217,102, DT Patent No. 2,732,356 and DD Patent No. 210,769, various disazo dyes are disclosed for textile dyeing and optical recording. Those dyes are similar to the dyes described herein. However, those dyes are not described for use in a thermal dye transfer system.

Accordingly, this invention comprises a neutral-black dye-doner element for thermal dye transfer comprising a support having thereon a dye layer dispersed in a polymeric binder, the dye comprising a 1-((4-phenylazo)phenylazo)-8-amino-2-naphthol.

In a preferred embodiment of the invention, the dye has the formula:

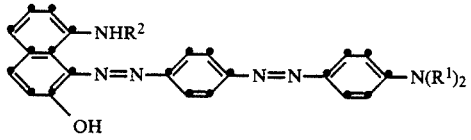

wherein:

each $R^1$ is independently a substituted or unsubstituted alkyl group of from 1 to about 6 carbon atoms, such as methyl, ethyl, propyl, isopropyl, butyl, pentyl, hexyl, methoxyethyl, benzyl, 2-cyanoethyl, methoxycarbonylmethyl, etc.; a substituted or unsubstituted aryl group of from about 5 to about 10 carbon atoms, such as phenyl, pyridyl, naphthyl, p-tolyl, p-chlorophenyl, etc.; or two $R^1$ groups may be joined together with the N atom to which they are attached to form a 5- or 6-membered heterocyclic ring, such as

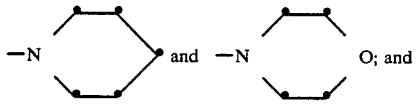

$R^2$ is hydrogen or $R^1$.

In another preferred embodiment of the invention, $R^2$ in the above formula is hydrogen. In yet another preferred embodiment of the invention, $R^1$ is ethyl or n-butyl. In still another preferred embodiment, each phenylazo group is independently substituted with a nitro; halogen, such as chlorine, bromine, or fluorine; or alkyl group having from 1 to about 6 carbon atoms such as those listed above for $R^1$.

The neutral-black dyes used in this invention are relatively neutral over the visible range (400–700 nm), have good transfer characteristics and good dye light-stability.

Compounds included within the scope of the invention include the following:

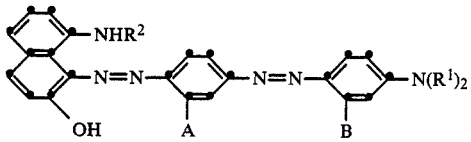

| Compound | $R^1$ | $R^2$ | A | B |
|---|---|---|---|---|
| 1 | $C_2H_5$ | H | H | H |
| 2 | $C_2H_5$ | H | H | $CH_3$ |
| 3 | $C_2H_5$ | H | H | F |
| 4 | n-$C_4H_9$ | H | H | H |
| 5 | n-$C_4H_9$ | H | $NO_2$ | H |
| 6 | $C_2H_5$ | H | H | F |
| 7 | n-$C_4H_9$ | H | H | F |
| 8 | n-$C_4H_9$ | H | $NO_2$ | F |
| 9 | n-$C_3H_7$ | H | H | H |
| 10 | n-$C_3H_7$ | H | $NO_2$ | H |
| 11 | n-$C_3H_7$ | H | $NO_2$ | $CH_3$ |
| 12 | n-$C_4H_9$ | $CH_3$ | H | H |
| 13 | n-$C_4H_9$ | $CH_3$ | H | F |

A dye-barrier layer may be employed in the dye-doner elements of the invention to improve the density of the transferred dye. Such dye-barrier layer materials include hydrophilic materials such as those described and claimed in application Ser. No. 934,969 entitled "Dye-Barrier and Subbing Layer for Dye-Doner Element Used in Thermal Dye Transfer" by Vanier, Lum and Bowman, filed Nov. 25, 1986.

The dye in the dye-doner element of the invention is dispersed in a polymeric binder such as a cellulose derivative, e.g., cellulose acetate hydrogen phthalate, cellulose acetate, cellulose acetate propionate, a cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-doner element may be coated on the support or printed thereon by a printing technique such as a gravure process.

Any material can be used as the support for the dye-doner element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 2 to about 30 μm. It may also be coated with a subbing layer, if desired.

The reverse side of the dye-doner element may be coated with a slipping layer to prevent the printing head from sticking to the dye-doner element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-doner element of the invention usually comprises a support having thereon a dye image-receiving layer. The support may be a transparent film such as a poly(ether sulfone), a polyimide, a cellullose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-doner elements of the invention are used to form a dye transfer image. Such a process comprises imagewise-heating a dye-doner element as described above and transferring a dye image to a dye-receiving element to form the dye transfer image.

The dye-doner element of the invention may be used in sheet form or in a continuous roll or ribbon. If a continuous roll or ribbon is employed, it may have only the neutral-black dye thereon as described above or may have alternating areas of other different dyes, such as sublimable magenta and/or yellow and/or cyan or other dyes. Such dyes are disclosed in U.S. Pat. No. 4,541,830, the disclosure of which is hereby incorporated by reference. Thus, one-, two-, three- or four-color elements (or higher numbers also) are included within the scope of the invention.

In a preferred embodiment of the invention, the dye-doner element comprises a poly(ethylene terephthalate) support coated with sequential repeating areas of magenta, yellow, cyan and the neutral-black dye as described above, and the above process steps are sequentially performed for each color to obtain a four-color dye transfer image. Of course, when the process is only performed for a single color, then a monochrome dye transfer image is obtained.

Thermal printing heads which can be used to transfer dye from the dye-doner elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-doner element as described above, and (b) a dye-receiving element as described above, the dye-receiving element being in a superposed relationship with the dye-doner element so that the dye layer of the doner element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a multi-color image is to be obtained, the above assemblage is formed on several occasions during the time when heat is applied by the thermal printing head. After the first dye is transferred, the elements are peeled apart. A second dye-doner element (or other area of the doner element with a different dye area) is then brought in register with the dye-receiving element and the process repeated. The other colors are obtained in the same manner.

The following examples are provided to illustrate the invention.

PREPARATIVE EXAMPLE 1

Preparation of Compound 4. 8-Amino-1-(4-(4-dibutylaminophenylazo)phenylazo)-2-naphthol Ten grams of 8-amino-2-naphthol were added to a mixture of acetic anhydride/formic acid (40 mL:20 mL). The mixture was warmed at 50° C. for one hour and then quenched on ice. After stirring for some time, the product solidified and was filtered off. Recrystallization from ethanol gave 6 g of 8-formamido-2-naphthol melting at 203°–205° C.

Fifteen grams of 4-acetamidoaniline were dissolved in water (100 mL) and conc. hydrochloric acid (30 mL) and diazotized by the addition of sodium nitrite (7 g) at 5° C. Dibutylaniline (20 g) was dissolved in acid/water (1:1 600 mL), cooled to 5° C. and the diazonium solution added with stirring. The reaction mixture was allowed to stand overnight and then filtered. The dried product 4(4-acetamidophenylazo)-N,N-dibutylaniline weighed 33 g.

The acetamido compound (9 g) was refluxed gently in ethanol (100 mL) and water (10 mL) containing sodium hydroxide (6 g) for 90 minutes until the starting material had been consumed. The solution was cooled, diluted with water, and the crystallized product was filtered off. The yield of 4-(4-aminophenylazo)-N,N-dibutylaniline was 6.5 g.

The amino dye from the above hydrolysis was dissolved in acetic acid/water (5:1 200 mL), cooled to 5° C. and diazotized with sodium nitrite (1.5 g). The diazonium solution was then added to a solution of 8-formamido-2-naphthol (3.8 g) in methanol (400 mL) containing sodium acetate (30 g). After one hour the crude dye was filtered off. The formyl group was removed by dissolution in tetrahydrofuran and adding conc. hydrochloric acid (15 mL). The progress of the reaction was followed by thin-layer chromatography. After 4 hours there did not seem to be any further change and the reaction was worked up by pouring the mixture into sodium acetate solution. The product was filtered off and stirred with methanol to remove some yellow impurity. The yield of 8-amino-1-(4-(4-dibutylaminophenylazo)phenylazo)-2-naphthol was 7.5 g.

EXAMPLE 1

A dye-doner element was prepared by coating the following layers in the order recited on a 6 μm poly(ethylene terephthalate) support:

(1) subbing layer of duPont Tyzor TBT® titanium tetra-n-butoxide (0.16 g/m$^2$) from 1-butanol; and (2) a dye layer containing the bisazo black dye as identified above or control dye identified below (0.59 g/m$^2$) and FC-431® (3M Corp.) surfactant (0.03 g/m$^2$) in a cellulose acetate butyrate (17% butyryl and 28% acetyl) binder (0.32 g/m$^2$) coated from a tetrahydrofuran, acetone and cyclohexanone solvent mixture.

On the back side of the element was coated:

(1) a subbing layer of Bostik 7650® (Emhart Corp.) polyester (0.16 g/m$^2$) coated from a toluene and 3-pentanone solvent mixture; and (2) a slipping layer of Gafac RA-600® (GAF Corp.) polymer (0.043 g/m$^2$) and BYK-320® (BYK Chemie, USA) (0.01 g/m$^2$) in a poly(styrene-co-acrylonitrile) binder (70:30 wt. ratio) (0.54 g/m$^2$) coated from a toluene and 3-pentanone solvent mixture.

Control Dyes:

C-1:

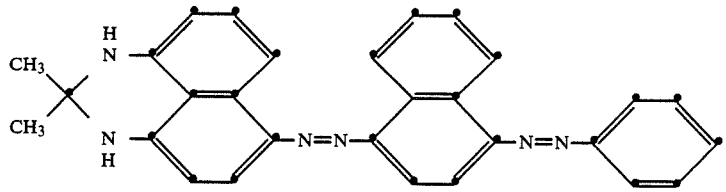

Sudan Black B

C-2

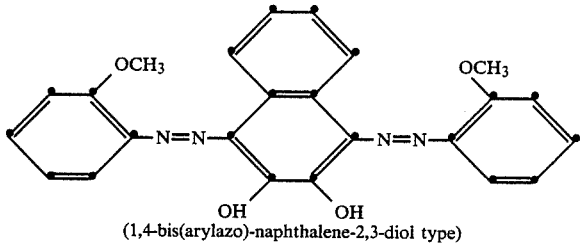

(1,4-bis(arylazo)-naphthalene-2,3-diol type)

C-3:

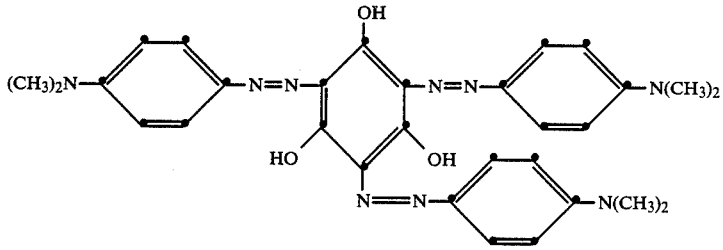

(2,4,6-tris(arylazo)-phloroglucinol type)

A dye-receiving element was prepared by coating a solution of Makrolon 5705® (Bayer A.G. Corporation) polycarbonate resin (2.9 g/m$^2$) in a methylene chloride and trichloroethylene solvent mixture on a 175 μm polyethylene terephthalate support containing titanium dioxide.

The dye side of the dye-doner element strip one inch (25 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a TDK Thermal Head L-133 (No. C6-0242) and was pressed with a spring at a force of 8 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were heated at increments from 0 up to 8.3 msec to generate a graduated density test pattern. The voltage supplied to the print head was approximately 21 v representing approximately 1.7 watts/dot (12 mjoules/dot).

The dye-receiving element was separated from the dye-doner element and the Status A red, green, and blue reflection densities were read. The maximum densities were recorded. Each test-image was then subjected to fading for 5 days, 5.4 kLux, 5400° K., 32° C., approximately 25% RH. The percent density loss for Status A-red (the most critical region shown by experience) was calculated. The following results were obtained:

TABLE 1

| | Status A D-max | | | Status A Red | |
|---|---|---|---|---|---|
| Dye | B | G | R | Initial Density | % Loss After Fade |
| 1 | 1.5 | 1.4 | 1.6 | 0.9 | −21 |
| 2 | 1.5 | 1.4 | 1.8 | 1.0 | −23 |
| 3 | 1.5 | 1.4 | 1.7 | 1.1 | −35 |
| 4 | 1.2 | 1.2 | 1.5 | 1.1 | −22 |
| 5 | 0.9 | 0.9 | 1.0 | 1.0 | −7 |
| C-1 | 0.8 | 1.1 | 1.4 | 1.2 | −38 |
| C-2 | 0.03 | 0.03 | 0.02 | * | * |
| C-3 | 0.2 | 0.2 | 0.3 | * | * |

*Too little dye was transferred to obtain accurate dye fade.

The above data show the invention dyes are quite neutral in hue (having approximately equal Status A blue, green, and red densities), transfer exceptionally well and are more light stable than the control dyes. Control dye C-1 appears visually blue-black because of the imbalance of high red and low blue density and has poorer light stability than the dyes of the invention. Control dyes C-2 and C-3 are more neutrally black, however both are essentially non-transferable.

The invention has been described in detail with particular reference to preferred embodiments thereof, but it will be understood that variations and modifications can be effected within the spirit and scope of the invention.

What is claimed is:

1. A neutral-black dye-doner element for thermal dye transfer comprising a support having thereon a dye layer dispersed in a polymeric binder, said dye comprising a 1-((4-phenylazo)phenylazo)-8-amino-2-naphthol.

2. The element of claim 1 wherein said dye has the formula:

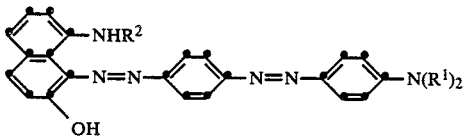

wherein:

each $R^1$ is independently a substituted or unsubstituted alkyl group of from 1 to about 6 carbon atoms, a substituted or unsubstituted aryl group of from about 5 to about 10 carbon atoms, or two $R^1$ groups may be joined together with the N atom to which they are attached to form a 5- or 6-membered heterocyclic ring; and $R^2$ is hydrogen or $R^1$.

3. The element of claim 2 wherein $R^2$ is hydrogen.

4. The element of claim 2 wherein $R^1$ is ethyl or n-butyl.

5. The element of claim 2 wherein each phenylazo group is independently substituted with a nitro, halogen or alkyl group having from 1 to about 6 carbon atoms.

6. The element of claim 1 wherein a dye-barrier layer is located between said dye layer and said support.

7. The element of claim 1 wherein the side of the support opposite the side having thereon said dye layer is coated with a slipping layer comprising a lubricating material.

8. The element of claim 1 wherein said support comprises poly(ethylene terephthalate) which is coated with sequential repeating areas of magenta, yellow, cyan and said neutral-black dye.

9. In a process of forming a neutral-black dye transfer image comprising imagewise-heating a dye-doner element comprising a support having thereon a dye layer comprising a dye dispersed in a polymeric binder and transferring a dye image to a dye-receiving element to form said neutral-black dye transfer image, the improvement wherein said dye comprises a 1-((4-phenylazo)phenylazo)-8-amino-2-naphthol.

10. The process of claim 9 wherein said dye has the formula:

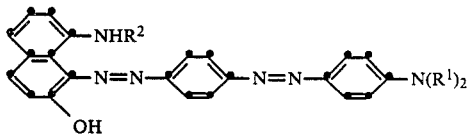

wherein:

each $R^1$ is independently a substituted or unsubstituted alkyl group of from 1 to about 6 carbon atoms, a substituted or unsubstituted aryl group of from about 5 to about 10 carbon atoms, or two $R^1$ groups may be joined together with the N atom to which they are attached to form a 5- or 6-membered heterocyclic ring; and $R^2$ is hydrogen or $R^1$.

11. The process of claim 10 wherein $R^2$ is hydrogen.

12. The process of claim 10 wherein $R^1$ is ethyl or n-butyl.

13. The process of claim 10 wherein each phenylazo group is independently substituted with a nitro, halogen or alkyl group having from 1 to about 6 carbon atoms.

14. The process of claim 10 wherein said support is poly(ethylene terephthalate).

15. In a thermal dye transfer assemblage comprising:

(a) a dye-doner element comprising a support having thereon a dye layer comprising a dye dispersed in a polymeric binder, and (b) a dye-receiving element comprising a support having thereon a dye image-receiving layer, said dye-receiving element being in a superposed relationship with said dye-doner element so that said dye layer is in contact with said dye image-receiving layer, the improvement wherein said dye comprises a 1-((4-phenylazo)phenylazo)-8-amino-2-naphthol.

16. The assemblage of claim 15 wherein said dye has the formula:

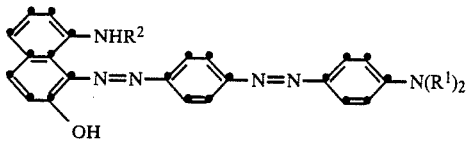

wherein:

each $R^1$ is independently a substituted or unsubstituted alkyl group of from 1 to about 6 carbon atoms, a substituted or unsubstituted aryl group of from about 5 to about 10 carbon atoms, or two $R^1$ groups may be joined together wtih the N atom to which they are attached to form a 5- or 6-membered heterocyclic ring; and $R^2$ is hydrogen or $R^1$.

17. The assemblage of claim 16 wherein $R^2$ is hydrogen.

18. The assemblage of claim 16 wherein $R^1$ is ethyl or n-butyl.

19. The assemblage of claim 16 wherein each phenylazo group is independently substituted with a nitro, halogen or alkyl group having from 1 to about 6 carbon atoms.

20. The assemblage of claim 15 wherein said support of the dye-doner element comprises poly(ethylene terephthalate) which is coated with sequential repeating areas of magenta, yellow, cyan and said neutral-black dye.

* * * * *